United States Patent [19]

Norris

[11] 4,016,019

[45] Apr. 5, 1977

[54] INTEGRATED INDICATOR SYSTEM FOR SOLVENT REMOVAL

[75] Inventor: Alan H. Norris, Rome, Ga.

[73] Assignee: Champion International Corporation, Stamford, Conn.

[22] Filed: Oct. 1, 1975

[21] Appl. No.: 618,611

[52] U.S. Cl. ..... 156/64; 34/89; 34/DIG. 8; 73/159; 73/556; 73/358; 116/114 Y; 156/72; 156/378; 428/913

[51] Int. Cl.[2] ..... F26B 21/10

[58] Field of Search ..... 73/159, 160, 356, 358; 116/114 Y, 114 V, 114.5; 34/89, DIG. 8; 252/408 R, 408 CC; 26/70; 428/913, 97; 156/72, 64, 378

[56] References Cited

UNITED STATES PATENTS

| | | | |
|---|---|---|---|
| 2,928,791 | 3/1960 | Locanti | 252/408 |
| 3,549,467 | 12/1970 | Keuchel et al. | 428/92 |
| 3,620,889 | 11/1971 | Baltzer | 73/356 |
| 3,847,139 | 11/1974 | Flam | 428/913 |
| 3,871,212 | 3/1975 | Neugroschl | 73/356 |

OTHER PUBLICATIONS

Thermochrom crayons & Detectotemp. paints, for measuring surfa ce temperature, Curtiss Wright, Nov. 15, 1960.

Thermochrom and Detectotemp. "cost reduction" check list, Nov.15, 1960.

Vermomelt, Murkal, Precision Temperature indicators.

*Primary Examiner*—Charles E. Van Horn
*Assistant Examiner*—Michael W. Ball
*Attorney, Agent, or Firm*—Evelyn M. Sommer

[57] ABSTRACT

Volatile, organic solvent is removed from textile articles that are provided with thermosensitive fibers capable of visually indicating predetermined maximum temperatures. Textile articles, such as tufted carpet, are heated under conditions effective to evaporate the volatile organic solvent under prevailing pressure conditions, as indicated by the thermosensitive fibers which are woven or tufted directly into and form a part of the textile articles, to remove the solvent from the textile articles.

8 Claims, 4 Drawing Figures

INTEGRATED INDICATOR SYSTEM FOR SOLVENT REMOVAL

This invention relates to the removal of volatile organic solvents from textile articles employing integrated thermosensitive indicating means. More particularly, this invention relates to the use of thermosensitive fibers that are integrated into solvent-wetted textile articles for visually indicating predetermined temperatures at which the organic solvents may be removed by heating.

Organic solvents have been commonly used by the textile industry in the production of various textile articles, such as fabrics, carpets and the like. Thus, volatile organic solvents, such as halogenated and nonhalogenated aliphatic and aromatic hydrocarbons having boiling points of between about 100° and 300° F, have been suggested, for example, as a replacement for water as a carrier for various chemicals that are utilized to treat fabrics, rugs, carpets and the like. For example, in the dyeing of polyester yarn for the production of carpet using disperse dyes, such as hydroxy anthraquinones, amino anthraquinones, azo dyestuffs, or the like, it is necessary to use an organic solvent or carrier to speed the absorption of the dyestuff by the yarn from the aqueous dye medium. The organic solvent is dispersed in the aqueous dye solution and is soluble in the polyester fibers. The dyestuff is insoluble in water, but is soluble in both the carrier and the fiber. A widely used carrier material, for example, is biphenyl.

Unfortunately, the use of such organic solvents or carriers presents a number of difficulties particularly in view of the fact that they are extremely flammable and therefore present a fire hazard in the finished textile article. The Federal Government has devised standards for testing textile articles, such as carpet, and the carpet must pass a flammability test before it can be sold. In the specific case of carpet, the presence of organic carrier material in the carpet can cause it to fail the so called "Pill Test," thus preventing the sale of the carpet.

In the Pill Test, a sample of carpet is provided with a methenamine tablet on the surface thereof in a draft free chamber. The tablet burns for about 90 to 100 seconds, either burning itself out or igniting the carpet. A carpet specimen passes the test if the charred portion does not extend to within one inch of an 8-inch diameter flattening frame placed on the sample. At least seven of eight specimens must pass the test before the carpet meets the standard. Accordingly, it is essential that the organic carrier material be substantially completely removed from the carpet in order to enable the carpet to pass the Pill Test.

In the case of carpet, the carrier is largely absorbed by the fiber and thus, scouring the carpet after dyeing is not fully effective in removing the organic carrier, although a portion of the organic carrier may be removed in such manner. However, it has been found that heating the carpet under conditions sufficient to evaporate the solvent so as to remove the organic solvent by means of volatilization will thereby drive it from the carpet.

Normally, after a carpet is dyed it is passed through a drying tunnel or oven in order to dry the carpet. When the carpet is dry, the temperature of the carpet will rise above the adiabatic water evaporation temperature and reach the temperature of the drier interior. However, until the carpet becomes dry and thus is at the same temperature as the drier interior, there is no means by which to know what temperature the carpet, per se, has reached in the drier. Obviously, with varying conditions of daily manufacture reliance upon the drier temperature results in the insufficient removal of carrier.

After the carpet is dyed, a latex adhesive is applied and a secondary backing is laminated in place. Once again, the carpet is passed through a heated oven and further solvent or carrier is removed, but to an unknown extent depending upon the full removal of water from the latex before the carpet exits from the oven. In normal carpet production, the carpet is carried by the selvage, on tenter pins. After the carpet exits from the laminating oven, it cannot be subjected to further heat treatments in order to volatilize the organic solvent, since it is conventional to trim the selvage from the carpet as it exits from the laminating oven. Accordingly, if the carpet then fails the Pill Test, it cannot be returned to the oven for further heat treatment.

A method has now heen discovered for the removal of volatile organic solvent from textile articles that are wetted with such solvent, which process comprises providing the textile article with a plurality of thermosensitive fibers which are capable of visually indicating a predetermined maximum temperature corresponding to at least the temperature at which the volatile solvent will evaporate under prevailing pressure conditions, but below the melting temperature of the main fibers of which the textile article is constructed, e.g., the backing fibers and tuft fibers of a carpet. Thus, for example, in the case of a tufted carpet that is wetted with an organic solvent, a plurality of thermosensitive fibers may be incorporated into the carpet during the fabrication thereof so that a visual examination of the carpet, after it has passed through the drier, will readily indicate the temperature that the carpet has reached while passing through the drier. It is preferred to use a plurality of thermosensitive fibers having different maximum indicating points, as hereafter discussed.

According to a preferred embodiment of the present invention a plurality of thermosensitive fibers are provided, each having a predetermined melting point, which differs one fiber from the other. Thus, certain of the thermosensitive fibers have a melting point below the evaporation temperature of the volatile organic solvent, other thermosensitive fibers have a melting point approximating the evaporation temperature of the solvent, while still other thermosensitive fibers are provided having a melting point above the evaporation temperature of the volatile solvent. The fibers may be formed into a yarn which is tufted into the selvages of the carpet. Thus, as the carpet emerges from the drying oven, visual inspection of the state of the thermosensitive fibers in the selvages will immediately indicate the temperature experienced by the carpet. If the thermosensitive fibers indicate that the carpet has not been heated at least as high as the temperature at which the solvent has evaporated, the carpet can be returned to the oven for further heating, since the selvage will not be trimmed away until the thermosensitive fibers indicate that the predetermined temperature has been achieved.

According to a further aspect of the invention, thermosensitive fibers are woven into the primary backing fabric and into the fabric of the subsequently-applied secondary backing prior to the utilization of the primary backing and secondary backing, respectively. In this manner, the carpet can be checked at different stages of the solvent-removal operation and on both front and back in order to determine whether the solvent has been adequately removed by volatilization thereof.

In order to gain a greater understanding of the present invention, reference is made to the invention as illustrated in the accompanying drawings, in which.

Figure 1:
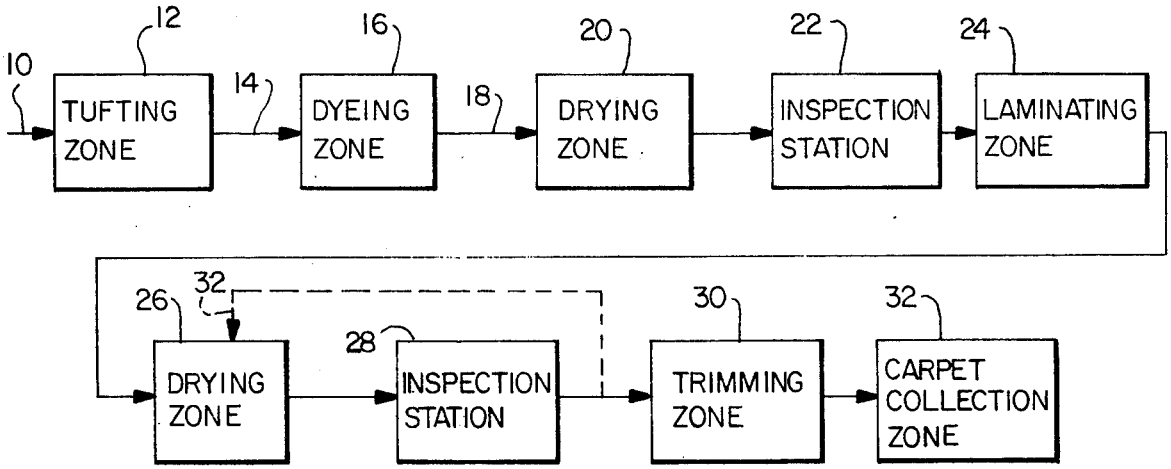
FIG. 1 is a schematic representation in the form of a flow sheet illustrating the solvent removal technique of the present invention.
Figure 2:
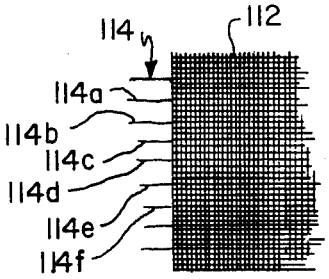
FIG. 2 is a bottom plan view of the primary backing of the present invention wherein thermosensitive fibers are provided as warp threads woven into the primary backing.

Referring more specifically to the drawings, the present invention will be demonstrated with respect to the manufacture of tufted carpet incorporating the thermosensitive fibers therein. As shown in FIG. 1, a base or primary backing fabric 10, formed of woven jute, for example, is passed to a tufting zone 12 for application of polyester tufts into the woven backing. A bottom plan view of the primary backing 10 is illustrated in FIG. 2 in which backing fabric 110 is composed of wefts 112 and warps 114. However, warps 114 include thermosensitive threads 114*a*, 114*b*, 114*c*, 114*d*, 114*e* and 114*f*. Each of the threads 114*a*–114*f* is designed to visually indicate a predetermined maximum temperature. Alternatively, the woven jute backing may contain a single, thermosensitive, multiply thread which comprises several threads and which is woven into the jute along with the normal warp threads. The thermosensitive thread may comprise, for example, three threads each melting at 220° F, 250° F and 280° F, respectively.

The thermosensitive fibers of the present invention may provide a visual indication of a maximum temperature either by color change in the fiber or a change in the physical state of the fiber. Thus, for example, the thermosensitive fiber may be a synthetic polymeric material having heat sensitive dyes or pigments incorporated therein, which dyes or pigments will change color at a predetermined temperature. Such materials are commercially available and are well-known to those skilled in the art. For example, such pigments are described in U.S. Pat. No. 2,928,791, which pigments each have a transition temperature in the range of between about 45° and 302° C. The "transition temperature" is the temperature at which the visual appearance, i.e., color, of the pigment changes. Similarly, dye materials such as 2, 4-dinitro phenylhydrazone, which will become colored at a predetermined temperature, are well-known to the art and may be incorporated into polymeric fibers to provide the thermosensitive fibers of the present invention.

According to a preferred embodiment of the present invention, the thermosensitive fiber is produced from various mixtures of different polymers so that the resulting fiber will have a melting point in the range of between about 240° F and about 315° F. Thus, a mixture of polyethylene and polypropylene may be employed, with the ratio varied to achieve a specific melting point. Thus, referring once again to FIG. 2 of the drawings, thread 114*a* may be, for example, a 400 denier, fibrillated polypropylene-polyethylene mixture melting at 290° F, while thread 114*b* is similarly a 400 denier fibrillated polypropylene-polyethylene mixture, but has a polypropylene/polyethylene ratio so as to provide a melting point of 280° F. Likewise, threads 114*c* to 114*f* are similar to threads 114*a* and 114*b*, with the exception that they each have a predetermined polymer ratio so as to possess melting points of 270° F (114*c*), 260° F (114*d*), 250° F (114*e*), and 240° F (114*f*) respectively. As will be hereinafter described, a mere visual inspection of threads 114*a* to 114*f* will indicate the temperature that the primary backing has experienced and permit an instant determination as to whether the organic solvent has been volatilized and removed.

Likewise, threads 114*a* to 114*c* may be replaced by a single multiply thread comprising, for example, three threads, each having melting points of 290° F, 270° F and 240° F, respectively, for example.

Referring again to FIG. 1, the primary backing 10 is passed to tufting zone 12 in which the primary backing is provided with tufts of a suitable synthetic yarn, such as polyester yarn tufts. However, in addition to the polyester yarn tufts, the selvages, i.e., the left-hand selvage and the right-hand selvage are provided with yarn tufts formed of the thermosensitive fibers of the present invention.

Figure 3:
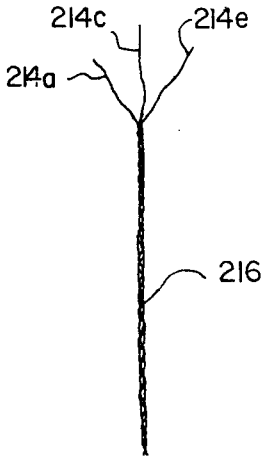
FIG. 3 is a side view of a short length of three thermosensitive threads being formed into a three-ply thread to be used in the present invention.

Referring now to FIG. 3 of the drawings, a three-ply thread composed of yarns 214*a*, 214*c* and 214*e* is illustrated. Yarn 214*a* is a 400 denier fibrillated polypropylene-polyethylene mixture having a melting point of 290° F, while threads 214*c* and 214*e* are identical thereto, but have melting points of 270° F and 250° F respectively, by virtue of their polypropylene/polyethylene ratio. The resulting three-ply thread 216 is tufted into the selvages of the carpet pile tufts that are to be trimmed off in finishing.

Figure 4:
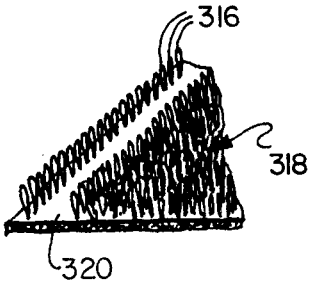
FIG. 4 is a fragmentary, side perspective view of the thermosensitive thread of FIG. 3 as tufted into the selvage of the tufted carpet.

Referring now to FIG. 4, a fragmentary view is illustrated of a three-ply thread 316 that has been tufted into primary backing 320, which tuft is formed of the three-ply thread similar to yarn 216 of FIG. 3. The tuft 316, as shown, is a fragmentary portion of the selvages of the carpet pile tufts 318 which are trimmed off in the finshing. Thus, for example, the three-ply thread forming tuft 316 comprises threads having a melting point of 290° F, 270° F, and 250° F, respectively. Such tufts are present in, for example, the left-hand selvage. Similarly, three-ply tufts comprised of threads melting at 280° F, 260° F, and 240° F, may be incorporated in the right-hand selvage. This gives a wide temperature range, and by simple visual inspection, the operator can determine a close approximation of the temperature that the particular portion of the carpet has experienced.

Referring once again to FIG. 1, the tufted polyester carpet 14 is passed to the dyeing zone 16 in which the carpet 14 is passed to the dyeing zone 16 in which the carpet is contacted with a dispersion comprising dispersed dyes and organic carrier, such as biphenyl. The dyed, organic solvent-wetted carpet 18 is withdrawn from dyeing zone 16 and passed to drying zone 20. The temperature of the drying zone 20 will depend upon the particular carpet and dyes that are employed, as well as the nature of the organic solvent. However, the temperature of the drying zone is maintained sufficiently high to evaporate as much solvent as possible from the carpet.

Upon emerging from the drying zone 20, the carpet is inspected at inspection station 22. The left-hand selvage, the right-hand selvage and the primary backing are inspected to determine the temperatures experienced by the carpet. Thus, for example, the presence of two unmelted, left-hand selvage thermosensitive threads and one unmelted right-hand selvage thermosensitive thread would indicate that the carpet reached 260° but not 270° F, since the left-hand selvage is composed of tufts of unmelted threads melting at 290° F, 270° F and a melted thread that melts at 250° F, while the right-hand selvage is composed of tufts of an unmelted thread melting at 280° F and melted threads that melt at 260° F, and 240° F, respectively. Additionally, an examination of the primary backing would similary indicate that three threads had melted and three threads were unchanged. Assuming that the organic solvent will evaporate at 255° F, the operator can assume that the solvent has been substantially completely removed.

Next, the carpet is passed to laminating zone 24 wherein the secondary backing fabric is applied by means of a backing adhesive. A typical backing adhesive for this purpose is a carboxylated, styrene-butadiene rubber latex containing various fillers, organic solvent dispersements, and thickeners. The secondary and primary backings may be made of any suitable material well-known to the art, such as a jute fabric or the like. The secondary backing is similarly provided with six thermosensitive fibers in the manner shown for the primary backing in FIG. 2. The laminated carpet is then withdrawn from the laminating zone 24 and passed to a drying zone 26 wherein the carpet is subjected to further heating.

The laminated carpet is withdrawn from the drying zone 26 and passed to inspection station 28 at which point the secondary backing is visually inspected, to see if the carpet has been heated to the desired temperature. Also, if the carpet had not previously hit the desired maximum temperatures, the selvages are inspected. At this point, if the operator is satisfied that the carpet has been subjected to a temperature sufficiently high to drive off the volatile solvent, and thereby pass the Pill Test, the right-hand and left-hand selvages may be trimmed from the carpet in trimming zone 30. However, if a visual inspection of the secondary backing and the right-hand and left-hand selvages indicates that the carpet has not been subjected to a temperature sufficient to drive off the volatile, organic solvent, the operator can recycle the carpet to further heat treatment as indicated by optional route 32. In general, if the operator observes that the carpet coming from the drying ovens has an inadequate heat history, the operator has the option of slowing passage of the carpet through the drying oven, increasing the oven temperature or discontinuing the trimming of the selvages, so that the carpet may be recycled through the drying oven. After the operator is satisfied that the solvent has been removed, the selvages are trimmed in zone 30 and the carpet is then collected in zone 34.

In the foregoing manner, the present invention permits an instantaneous, visual indication of the temperature experienced by the carpet after it emerges from each drying zone, and is able to compensate for the situation, if necessary, without a total loss of carpet by its failure of the Pill Test. As previously indicated, the carpet is carried through the heating zones by the selvage on tenter pins (not shown), and removal of the selvage means that no further heat treatment can be accomplished.

Although the invention has been described in considerable detail with particular reference to certain preferred embodiments thereof, variations and modifications can be effected with the spirit and scope of the invention as described hereinbefore, and as defined in the appended claims.

I claim:

1. A textile article having a plurality of thermosensitive fibers incorporated therein, each of said thermosensitive fibers being capable of indicating a predetermined maximum temperature by visual inspection, said maximum temperature being less than that of the melting point of the main construction fibers of said textile article, at least one of said thermosensitive fibers being capable of visually indicating a maximum temperature different from that of another of said thermosensitive fibers by undergoing a color change at said maximum temperature.

2. The textile article of claim 1 wherein said fibers each contain temperature sensitive pigments.

3. A method for the removal of a volatile organic solvent from a tufted textile article that is wetted with said solvent, which method comprises providing said tufted textile article with a plurality of thermosensitive fibers, each of said fibers being capable of visually indicating a predetermined maximum temperature, at least one of said fibers being capable of visually indicating a temperature substantially corresponding to the boiling point of said volatile solvent, other thermosensitive fibers being capable of visually indicating temperatures below and above the boiling point of said volatile solvent, and heating said textile article to a temperature at which said thermosensitive fibers indicate that the temperature of said textile article is substantially that corresponding to the temperature at which the volatile solvent evaporates.

4. The method of claim 3 wherein said tufted article is carpet.

5. The method of claim 4 wherein said carpet has selvages, and said thermosensitive fibers are tufted into said selvages.

6. The method of claim 3 wherein said carpet has a primary backing that is provided with thermosensitive fibers, said thermosensitive fibers being capable of visually indicating when said primary backing has been heated to a temperature of substantially corresponding to that at which the organic solvent evaporates.

7. The method of claim 3 wherein the fibers consist essentially of a fibrillated mixture of polyethylene and polypropylene, said mixture having a melting point in the range of between 240° and about 315° F.

8. A method for the removal of volatile organic solvent from a tufted textile article, which comprises providing a tufted article having synthetic yarn strands tufted through a primary backing, said primary backing having selvages, said selvages being provided with a tufted thermosensitive yarn comprising thermosensitive fibers, said fibers being capable of visually indicating a predetermined maximum temperature, said primary backing being a woven fabric having a plurality of said thermosensitive fibers woven into said primary backing fabric, passing said tufted article into a dyeing zone wherein said tufted article is contacted with a dye medium comprising a volatile organic solvent, said tufted article becoming wetted with said solvent, passing said tufted article to a drying zone in which said article is heated to a temperature at which said volatile solvent evaporates, visually inspecting said thermosensitive fibers to determine the temperatures experienced by said article, applying a secondary backing to said tufted article, said secondary backing having a plurality of said thermosensitive fibers woven therein, passing the resulting tufted article through a second drying zone to evaporate further solvent, inspecting the thermosensitive fibers of said secondary backing, and removing said selvages from said tufted article when said thermosensitive fibers indicate that said tufted article has experienced a temperature corresponding to that at which the solvent evaporates.

* * * * *